US007594291B1

(12) United States Patent
Carmen

(10) Patent No.: US 7,594,291 B1
(45) Date of Patent: Sep. 29, 2009

(54) PAINT BRUSH CLEANING DEVICE

(76) Inventor: David A. Carmen, 1434 Edwin Pl., Plainfield, NY (US) 07062

( * ) Notice: Subject to any disclaimer, the term of this patent is extended or adjusted under 35 U.S.C. 154(b) by 0 days.

(21) Appl. No.: 12/266,500

(22) Filed: Nov. 6, 2008

(51) Int. Cl.
*A46B 17/06* (2006.01)

(52) U.S. Cl. ..... 15/38; 15/21.1

(58) Field of Classification Search ..... 15/21.1, 15/38, 39
See application file for complete search history.

(56) References Cited

U.S. PATENT DOCUMENTS 2,853,085 A 9/1958 Torkelson
2,965,111 A 12/1960 Feigelman
3,116,745 A 1/1964 Burning
3,129,451 A * 4/1964 Colaianni ..... 15/303
3,860,021 A * 1/1975 Saric ..... 134/140
3,982,296 A * 9/1976 Russo ..... 15/38
D289,212 S 4/1987 Nakamura et al.
5,107,877 A 4/1992 Chipman
5,213,121 A 5/1993 O'Brien et al.
5,701,626 A * 12/1997 Zara et al. ..... 15/38

FOREIGN PATENT DOCUMENTS

WO WO 90/11900 * 10/1990

* cited by examiner

*Primary Examiner*—Randall Chin

(57) ABSTRACT

A paint brush cleaning device for cleaning paint brushes and paint rollers comprising a cylindrical reservoir housing a plurality of side brushes along the inside surface of the reservoir. On the bottom surface of the reservoir is a plurality of bottom brushes. A brush storage rack component, which holds the paint brushes and rollers, is insertable into the reservoir. A motor drives the brush storage rack component to spin such that the paint brushes and rollers brush against the side and bottom brushes.

5 Claims, 5 Drawing Sheets

PAINT BRUSH CLEANING DEVICE

FIELD OF THE INVENTION

The present invention is directed to a cleaning device. More particularly, the present invention is directed to a device for cleaning paint brushes and paint rollers.

BACKGROUND OF THE INVENTION

The present invention features a paint brush cleaning device for cleaning paint brushes and paint rollers. The cleaning device comprises a cylindrical reservoir housing a plurality of side brushes along the inside surface of the reservoir. On the bottom surface of the reservoir is a plurality of bottom brushes. A brush storage rack component, which holds the paint brushes and rollers, is insertable into the reservoir. A motor drives the brush storage rack component to spin such that the paint brushes and rollers brush against the side and bottom brushes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
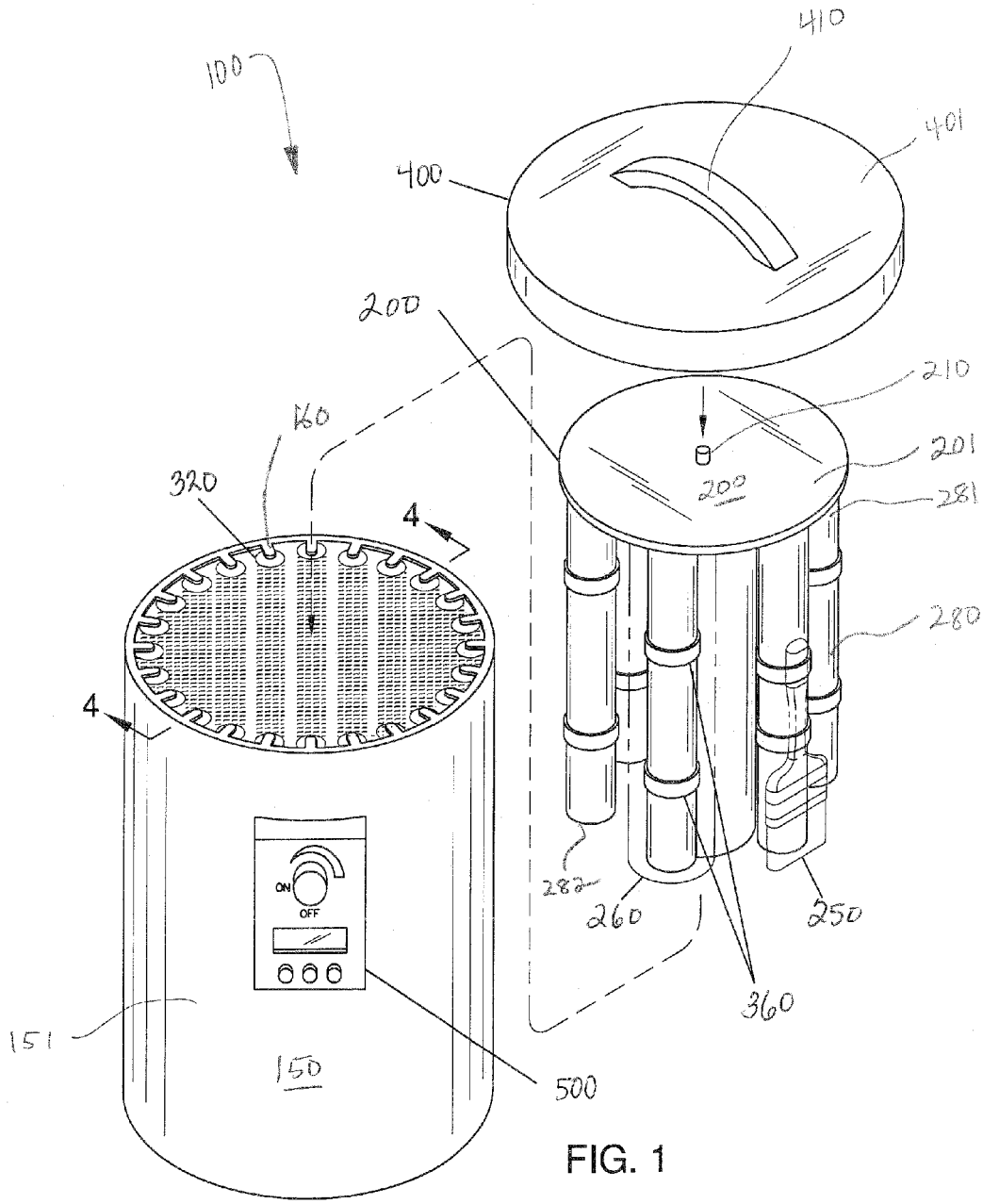
FIG. 1 is a perspective view of the paint brush cleaning device of the present invention.

The following is a listing of numbers corresponding to a particular element refer to herein:

100 paint brush cleaning device
150 reservoir
151 outside surface of reservoir
152 inside surface of reservoir
153 bottom of reservoir
155 pad
160 reservoir wing
162 middle reservoir wing
200 brush storage rack disc
201 top surface of storage rack disc
210 storage rack disc notch
220 spinning component
221 first end of spinning component
222 second end of spinning component
225 motor connecting component
250 paint brush
260 paint roller
280 brush attachment spoke
281 first end of brush attachment spoke
282 second end of brush attachment spoke

Figure 2:
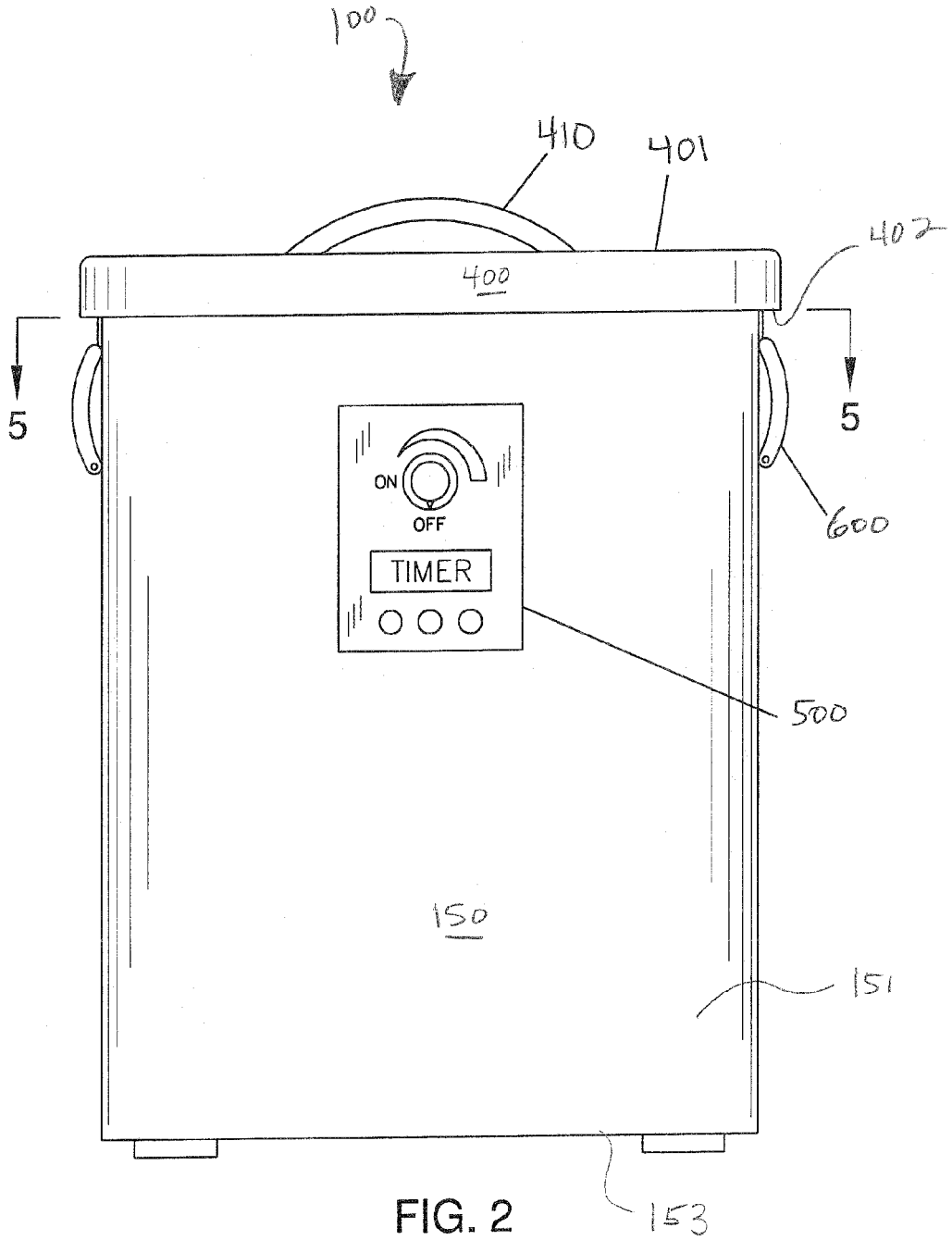
FIG. 2 is a front view of the paint brush cleaning device of the present invention.
Figure 3:
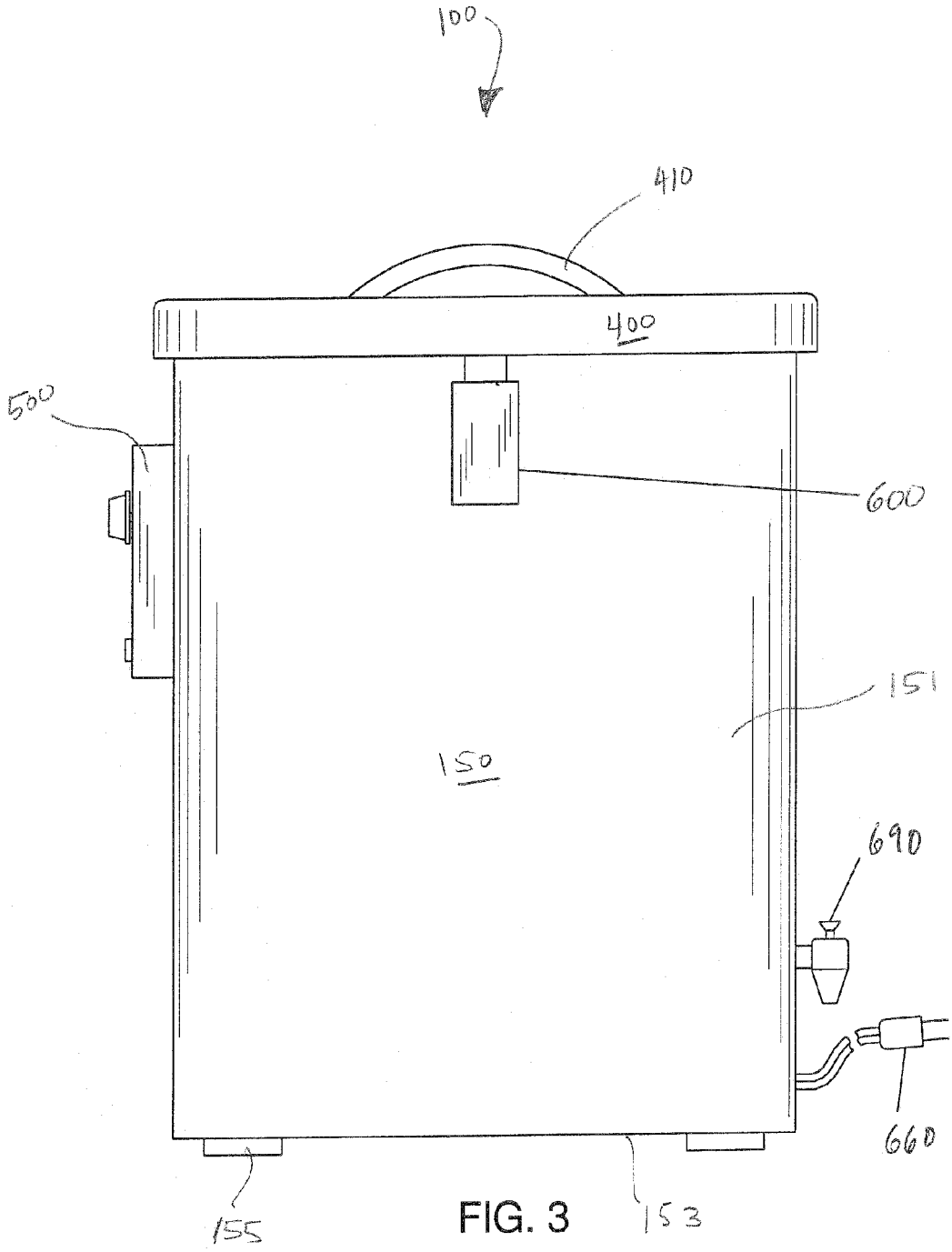
FIG. 3 is a side view of the paint brush cleaning device of the present invention.
Figure 4:
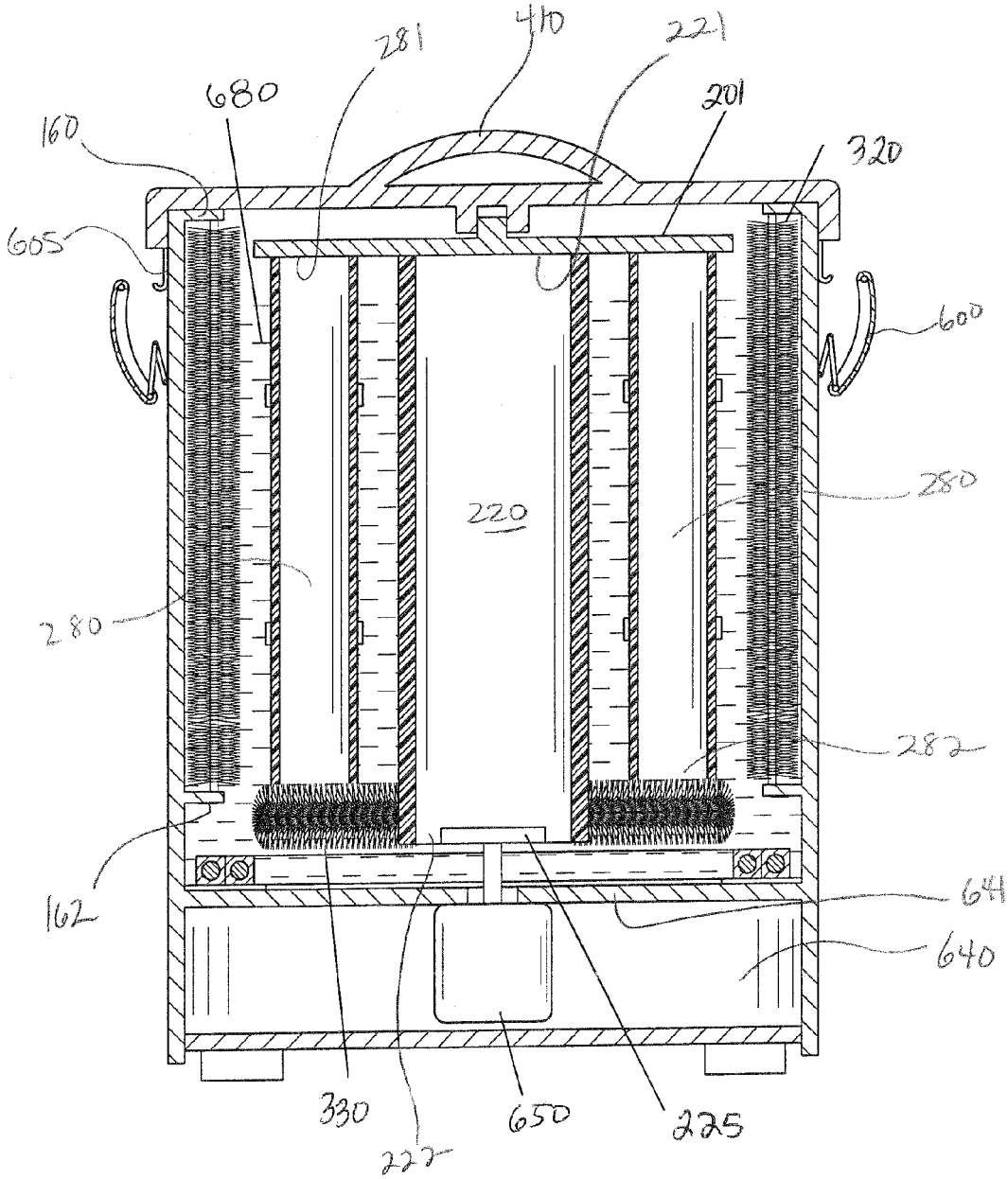
FIG. 4 is a front cross sectional view of the paint brush cleaning device of the present invention.
Figure 5:
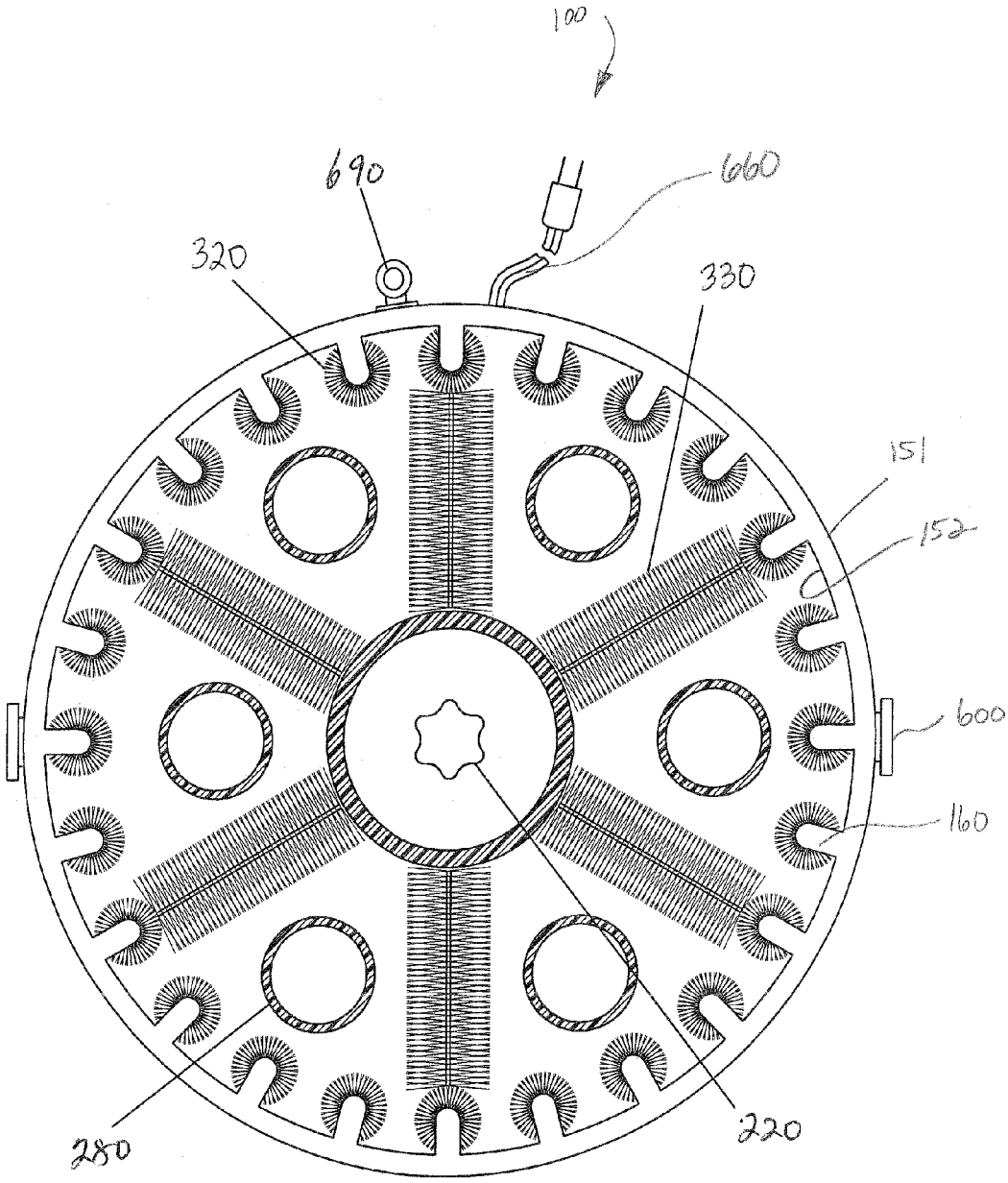
FIG. 5 is a top view of the paint brush cleaning device of the present invention.

320 side brush
330 bottom brush
360 strap (e.g., hook-and-loop fastener)
400 lid
401 top surface of lid
402 bottom surface of lid
410 handle
500 control panel
600 latch
605 latch hook
640 motor compartment
641 top surface of motor compartment
650 motor
660 power cord
680 cleaning solution
690 drain component Referring now to FIGS. 1-5, the present invention features a paint brush cleaning device for cleaning paint brushes and paint rollers.

The paint brush cleaning device comprises a hollow cylindrical reservoir having an outside surface, an inside surface, a bottom, and an open top. Disposed at the bottom of the reservoir is a motor compartment for housing a motor.

Disposed on the inside surface of the reservoir at the top is a plurality of top reservoir wings. The top reservoir wings extend perpendicularly to the inside surface of the reservoir and extend inward toward the center of the reservoir. The reservoir wings are for attaching a cylindrical side brush to the inside surface of the reservoir (see FIG. 4). The side brushes have a first end and a second end, the first end being attached to the reservoir wing. The second end attaches to a middle reservoir wing, similar to the top reservoir wing but disposed near the top surface of the motor compartment.

The side brushes are for brushing the paint brushes and rollers as they are spun inside the reservoir. A plurality of bottom brushes is attached to the top surface of the motor compartment. The bottom brushes also brush the paint brushes and rollers as they are spun inside the reservoir.

A removable lid can be attached to the top of the reservoir. The lid has a top surface, a bottom, and an outer edge. A handle is disposed on the top surface of the lid. Disposed on the bottom of the lid at the outer edge is a latch hook. The latch hook allows a latch disposed on the outside surface of the reservoir to clamp down the lid to secure it to the top of the reservoir.

A brush storage rack component is insertable into the reservoir via the open top. The brush storage rack comprises a brush storage rack disc having a top surface, a bottom surface, a center, and an outer edge. Extending perpendicularly from the bottom surface of the storage rack disc is a plurality of brush attachment spokes. Each attachment spoke has a first end and a second end, the first end being attached to the bottom surface of the storage rack disc. The attachment spokes are attached near the outer edge of the storage rack disc in a symmetrical fashion (see FIG. 1, FIG. 5). The attachment spokes are for holding paint brushes or rollers.

In some embodiments, the paint brushes or rollers are secured to the attachment spokes via an attachment means (e.g., an adjustable strap).

Extending downward perpendicularly from the center of the bottom surface of the storage rack disc is a spinning component. The spinning component has a first end and a second end. The second end of the spinning component connects to the motor via a motor connecting component that extends from the motor through the top surface of the motor compartment (see FIG. 4). The motor causes the spinning component to spin.

In some embodiments, a control panel for turning the device on and off is disposed on the outside surface of the reservoir. In some embodiments, a power cord for connecting to an electrical outlet connects to the motor. In some embodiments, the control panel comprises a plurality of buttons so that the user can choose from a variety of different cleaning cycles.

In some embodiments, a storage rack disc notch is disposed on the first end of the storage rack disc. The storage rack disc notch is for engaging the bottom surface of the lid. In some embodiments, engaging the bottom surface of the lid helps allow the spinning component to remain properly aligned within the reservoir.

In some embodiments, a drain component is disposed in the reservoir so as to allow the drainage of a cleaning solution or the like from within the reservoir. For example, a user may wish to drain soapy water from within the reservoir without having to pick the device up and dump the water from the top of the reservoir.

In some embodiments, one or more pads are attached to the bottom of the reservoir to help prevent the reservoir from slipping or sliding when it is use.

In some embodiments, the paint brush cleaning device of the present invention further comprises an on-off switch. In some embodiments, the paint brush cleaning device of the present invention further comprises a heating element for warming the water. In some embodiments, warm water may not be readily available (e.g., on a construction site), so a user may use the heating element to warm the water before use.

The paint brush cleaning device of the present invention may be constructed from a variety of materials. For example, in some embodiments, the paint brush cleaning device is constructed from a material comprising a plastic, a metal, a fabric, a rubber, the like, or a combination thereof.

As used herein, the term "about" refers to plus or minus 10% of the referenced number. For example, an embodiment wherein the reservoir is about 2 feet in diameter includes a reservoir that is between 1.8 and 2.2 feet in diameter.

The paint brush cleaning device may be constructed in a variety of sizes. For example, in some embodiments, the reservoir is between about 1 to 2 feet in diameter. In some embodiments, the reservoir is between about 2 to 3 feet in diameter.

In some embodiments, the reservoir is between about 1 to 2 feet in height as measured from the top to the bottom. In some embodiments, the reservoir is between about 2 to 3 feet in height as measured from the top to the bottom.

Example 1

Use of the Paint Brush Cleaning Device

The following example describes a use of the paint brush cleaning device of the present invention. A user wishes to clean paint residue from his brushes and rollers. The user attaches his rollers and brushes to the brush attachment spokes and secures them to the spokes with straps. The user inserts the brush storage rack component into the reservoir, making sure that the second end of the spinning component engages the motor connecting component. He then fills the reservoir with warm water and soap. Next, he attaches the lid to the top of the reservoir, making sure that the storage rack disc notch engages the bottom surface of the lid. The user uses the latches disposed on the outside surface of the reservoir to clamp down the lid via the latch hooks.

Next the user turns the device on via a button on the control panel (e.g., "Step 1 button"). The motor causes the spinning component to function as an agitator and repeatedly rotate about 180 degrees in a first direction and then spin 180 degrees in the opposite direction. This removes the residue from the user's brushes and rollers.

The user drains the soapy water via the drain component and refills the reservoir with a rinsing solution. He then turns the device on again via a button on the control panel (e.g., "Step 2 button"), which causes the spinning component to agitate in the same manner as before.

Lastly, the user drains the rinsing solution via the drain component. He turns the device on again via a button on the control panel (e.g., "Step 3 button"). The spinning component now spins continuously 360 degrees in a centrifuge-like manner. This causes the moisture to shake from the brushes and the rollers until they are dry.

The following the disclosures of the following U.S. Patents are incorporated in their entirety by reference herein: U.S. Pat. No. 2,965,111; U.S. Pat. No. 5,213,121; U.S. Pat. No. 5,107,877; U.S. Pat. No. 2,853,085; U.S. Pat. No. 3,116,745.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A paint brush cleaning device for cleaning paint brushes and paint rollers, said paint brush cleaning device comprising:

(a) a hollow cylindrical reservoir having an outside surface, an inside surface, a bottom, a center, and an open top;

(b) a motor compartment for housing a motor; wherein the motor compartment is disposed at the bottom of the reservoir and has a top surface;

(c) a plurality of top reservoir wings disposed on the inside surface of the reservoir at the top; wherein the top reservoir wings extend perpendicularly to the inside surface of the reservoir and extend inward toward the center of the reservoir;

(d) a plurality of middle reservoir wings disposed near the top surface of the motor compartment;

(e) a plurality of cylindrical side brushes, each side brush having a first end and a second end; wherein the first end of each side brush is attached to a top reservoir wing and the second end of each side brush is attached to a middle reservoir wing;

(f) a plurality of bottom brushes attached to the top surface of the motor compartment;

(g) a lid removably attached to the top of the reservoir; wherein the lid has a top surface, a bottom, and an outer edge; wherein a handle is disposed on the top surface of the lid;

(h) a brush storage rack component insertable into the reservoir via the open top; wherein the brush storage rack comprises a brush storage rack disc having a top surface, a bottom surface, a center, and an outer edge;

(i) a plurality of brush attachment spokes extending perpendicularly from the bottom surface of the storage rack disc; wherein each attachment spoke has a first end and a second end, the first end being attached to the bottom surface of the storage rack disc; wherein each attachment spoke is attached near the outer edge of the storage rack disc; wherein the attachment spokes are for holding the paint brushes or the rollers via an attachment means;

(j) a spinning component extending downward perpendicularly from the center of the bottom surface of the storage rack; wherein the spinning component has a first end and a second end; wherein the second end of the spinning component connects to the motor via a motor connecting component that extends from the motor through the top surface of the motor compartment; wherein the motor causes the spinning component to spin;

(k) a storage rack disc notch disposed on the top surface of the storage rack disc; wherein the storage rack disc notch is for engaging the bottom of the lid; and (l) a drain component disposed in the reservoir so as to allow drainage of a cleaning solution from within the reservoir;

wherein when the spinning component spins the side brushes and the bottom brushes brush the paint brushes and the rollers.

2. The paint brush cleaning device of claim 1, wherein one or more pads are attached to the bottom of the reservoir to help prevent the reservoir from slipping or sliding when it is in use.

3. The paint brush cleaning device of claim 1, wherein the paint brush cleaning device further comprises an on-off switch.

4. The paint brush cleaning device of claim 1, wherein the paint brush cleaning device further comprises a heating element for warming the cleaning solution or water.

5. The paint brush cleaning device of claim 1, wherein a latch hook is disposed on the bottom of the lid at the outer edge, wherein the latch hook allows a latch disposed on the outside surface of the reservoir to clamp down the lid to secure the lid to the top of the reservoir.

* * * * *